US005503349A

United States Patent [19]

Chertok

[11] Patent Number: 5,503,349

[45] Date of Patent: Apr. 2, 1996

[54] ROLL-STAND BRAKE

[75] Inventor: Allan Chertok, Bedford, Mass.

[73] Assignee: Certek Corporation, Bedford, Mass.

[21] Appl. No.: 90,251

[22] Filed: Jul. 9, 1993

[51] Int. Cl.[6] ..... B65M 23/06

[52] U.S. Cl. ..... 242/422.2

[58] Field of Search ..... 242/421, 421.1, 242/421.2, 421.3, 421.4, 422, 422.2, 559.1; 218/87; 310/67 R, 263

[56] References Cited

U.S. PATENT DOCUMENTS

| | | | |
|---|---|---|---|
| 1,920,897 | 8/1933 | Shoults . | |
| 2,052,788 | 9/1936 | Miller . | |
| 2,223,974 | 12/1940 | Thompson et al. . | |
| 2,280,973 | 4/1942 | Philippi . | |
| 2,485,757 | 10/1949 | Michel . | |
| 2,666,597 | 1/1954 | Wood . | |
| 2,685,947 | 8/1954 | Votrian . | |
| 2,709,507 | 5/1955 | Trickey . | |
| 2,777,964 | 1/1957 | DiMino . | |
| 2,796,222 | 6/1957 | Frankel | 242/75 |
| 2,838,253 | 6/1958 | Jacobsen | 242/75.47 |
| 2,840,206 | 6/1958 | Logan . | |
| 2,902,232 | 9/1959 | Jacobsen | 242/75.47 |
| 2,975,991 | 3/1961 | Michel | 242/75.51 |
| 2,995,968 | 8/1961 | Tomberg . | |
| 3,081,961 | 3/1963 | Kron | 242/75.47 |
| 3,257,086 | 6/1966 | Drenning | 242/75.4 |
| 3,262,651 | 7/1966 | Henderson et al. | 242/75.5 |
| 3,463,414 | 8/1969 | Eastcott | 242/75.44 |
| 3,792,868 | 2/1974 | Flagg . | |
| 3,963,250 | 6/1976 | Flagg . | |
| 4,199,118 | 4/1980 | Tetro et al. | 242/75.44 |
| 4,278,213 | 7/1981 | Rubruck . | |
| 4,286,757 | 9/1981 | Wirth | 242/75.44 |
| 4,697,408 | 10/1987 | Kohata et al. | 242/75.45 |
| 4,844,371 | 7/1989 | Tahara | 242/75.44 |
| 4,915,319 | 4/1990 | Gerber . | |
| 5,051,641 | 9/1991 | Weh . | |
| 5,234,177 | 8/1993 | Maji et al. | 242/75.47 |

OTHER PUBLICATIONS

D. R. Shoults and C. J. Rife, *Electric Motors in Industry*, pp. 314–317, John Wiley & Sons, Inc., New York, 1942.

Warner Electric circular.

Tidland circular.

Fossaluzza circular.

Hoffman, H. Weh; Landrath, J.; Mosebach, H.; Poschadel, J.; "Directed–Driven Permanent–Magnet Excited Synchronous Generator for Variable Speed Operation," *Proc. of the 1988 European Wind Energy Conference*, Jun. 1988.

*Primary Examiner*—John P. Darling

*Attorney, Agent, or Firm*—Cesari and McKenna

[57] ABSTRACT

A brake (26) employed to control web tension on a roll stand (10) is provided as a generator whose rotor shaft (38) is mounted on the roll stand's core-coupler spindle (16). The rotor (36) may be journaled in the generator's stator assembly (52) so that the spindle (16) supports the entire generator, and alignment problems that might otherwise require complicated flexible couplings, and excessive axial protrusion of the generator into service aisles are avoided. In another version, the generator stator (52) is mounted directly on the roll stand's arm (12) so that generator rotor-stator alignment is set by the journaling of the spindle (16) in the arm (12). Accurate web tension results from current feedback for control of the generator load.

22 Claims, 8 Drawing Sheets

ROLL-STAND BRAKE

BACKGROUND OF THE INVENTION

The present invention is directed to web-tensioning brakes for roll stands and in particular to brakes of the type that act essentially as generators connected to loads so that, when they are driven by the rotating roll, they exert a drag on it and thereby apply tension to web material being unwound from the roll.

Many industrial processes that convert sheet material to finished goods start with a roll of material supported on a roll stand, from which the sheet material is unwound. For most such processes, one of the process variables whose control is important is the web tension. For this purpose, brakes on the unwind roll stand resist its rotation and thereby tension the web.

Most brakes used for this purpose are friction brakes actuated by pneumatic, hydraulic, or electromagnetic means. Brake pads and rotor disks or drums wear when friction brakes are employed, and they require frequent attention. They also produce dust that can contaminate the workplace and the product. And some installations require forced-air or water cooling to keep the brake temperature at a safe level and reduce the rate at which the brakes wear.

In comparison with friction brakes, then, generator-type brakes would appear to have significant advantages. Clearly, generator-type brakes produce little wear and dust in comparison with friction brakes. Furthermore, the power extracted by the generator, being in the form of electricity, may be readily conveyed to a remote ballast resistor for safe dissipation to ambient air or applied to other process uses. A further advantage of generator-type brakes relative to pneumatic or hydraulic types is that their torque can be rapidly varied by direct electronic means, so the tension-control system is potentially more responsive than it would be if it employed electro-pneumatic or electro-hydraulic pressure modulators and brake-pad actuators, which depend to some extent on the movement of mechanical parts such as brake calipers. So it is not surprising that numerous proposals have been made over the years to employ generator-type brakes for this purpose.

Despite a number of such proposals, however, the friction brake has been the predominant, although not exclusive, type used for web tension control of all but the largest roll sizes. Even for large systems employing generator-type brakes, the cost savings in comparison with friction brakes have in some cases been disappointing.

Regardless of whether the brake is of the friction or the generator type, the control system must operate it in such a manner as to keep tension at a desired level despite, for instance, changes in roll radius as the web material is paid out. An early example of such a control system is that described in U.S. Pat. No. 2,052,788 to Miller, which was based on the recognition that keeping brake power constant in a constant-web-speed process will result in constant web tension. Since power is the product of torque and angular velocity, Miller placed an inductor in the generator load circuit so that generator output current—and thus generator torque—would decrease as the roll's angular speed—and thus the generator output frequency-increased with the reduction in roll radius that occurs as the roll pays out the web.

An analogous approach for friction brakes is practiced in control systems that employ a sensing arm or ultrasonic sensor to observe roll radius and decrease brake torque as the radius thus observed decreases so as to avoid the tension increase that would otherwise result.

The Miller and roll-radius-sensing arrangements are both open-loop brake-torque control systems. Being used when particularly high tension accuracy is not required, they are based on measurements, like generator current and roll radius, that are relatively inexpensive to make. When tension-control is required, however, designers have turned to systems that control tension more directly.

One such approach employs a dancer roll, i.e., a roll that can move up and down or fore and aft and that is so loaded, whether by gravity or, for instance, by pneumatic cylinders, that it applies a constant tensioning force to the web so long as the roll is maintained at the central point of its operating range. The brake-torque-control strategy for dancer-roll systems is to sense the dancer-roll position and so control the brake torque as to keep the dancer-roll position substantially constant.

Although dancer-roll systems can be relatively accurate when faced only with fairly slow system variations, they ordinarily are afflicted with certain system lags that make them less responsive to wide-band disturbances such as those that result from roll eccentricity. Moreover, the need to install the dancer roll can make the use of such a system impractical for retrofit purposes because there may be no room for the extra equipment. Even when installed as original equipment, such an approach can be quite expensive. Dancer rolls and supporting bearings and shaft hangers are costly. This is particularly true for wide webs, for which the dancer rolls must be of substantial diameter in order to avoid unreasonable deflections. The expense problem can be multiplied in circumstances in which, in order to obtain the necessary accuracy, the requisite wrap angle can be insured only by providing further, idler rollers.

To eliminate dancer roll's lag problems, which largely stem from roll inertia, some installations make direct tension measurements by employing an idler roller and a load cell that measures radial loads on the idler roller's bearings that result from web tension. The resultant output is compared with a target value, and brake force applied is based on the error output of the comparison. Such systems have at least been advertised to yield high accuracies, and they respond faster than dancer-roll arrangements. But they are subject to much the same retrofit difficulties as dancer-roll systems, and they are usually at least as expensive.

SUMMARY OF THE INVENTION

Our generator-brake invention results from a recognition that a significant increase in acceptability and convenience, as well as a significant reduction in cost, will result from improving the manner in which the brake is installed on the roll-stand arm. In accordance with one aspect of the invention, the generator rotor is mounted directly on, and supported by, the roll-stand arm itself. This is accomplished by providing the generator's rotor with an axial recess that receives the roll-stand-arm spindle so that the rotor is mounted on and supported by the spindle. By employing this mounting approach, my invention aligns the generator and spindle automatically.

This eliminates what I have recognized as a significant barrier to more-widespread acceptance of generator-type roll-stand brakes. Specifically, coupling of a generator-type brake with a conventional shaft to the roll-stand spindle has heretofore involved the use of a high-torque flexible coupling. This results in a configuration that is not only expensive but also too long and may protrude into service aisle ways. In accordance with my invention, on the other hand, the generator-type brake is designed for installation in such a manner as automatically to eliminate the types of alignment problems that necessitate flexible couplings and to minimize its axial protrusion into service aisle ways.

In accordance with another aspect of my invention, which is more applicable to retrofitting situations, the rotor shaft receives the roll-stand-arm spindle in a central recess as before, but the stator is rotably mounted on the rotor so that the generator can be mounted as a unit on the spindle, which thereby supports both stator and rotor in what is known in other contexts as a "shaft-hung" configuration. Again, alignment is automatically achieved without a flexible coupling.

Both of these aspects of the invention benefit from yet another aspect of the invention, which is an improved brake control system. This aspect of the invention is based on the recognition that it is not necessary to resort to expensive approaches such as those of dancer-roll or direct-tension-measurement systems in order to obtain the high accuracy to which those systems are directed. It employs the principle that the power expended in pulling the web from a braked roll can be computed either as the product of roll torque and angular speed or as the product of web speed and tension. To some extent, certain of the open-loop torque approaches such as Miller's, described above, make use of this principle. But I take full advantage of the fact that, by equating these two products, one can infer web tension from the other three quantities, whose determination is quite inexpensive in comparison with direct tension measurements.

Specifically, I sense generator current, which can be measured inexpensively, for use as an indicator of torque. And since direct measurements of web speed and generator angular speed can be obtained inexpensively by using, say, angle encoders, I either measure both directly or infer one from the other via a measurement of roll radius. I then feed back the current measurement to control the generator load in response to the difference between the measured current level and a target current level that the other measurements indicate is necessary to achieve a desired tension. This value can be determined accurately because, even though the generator current does not in general bear a simple proportional relationship to the torque that the web applies to the roll, the quantities necessary for inferring that torque from generator current can themselves be measured inexpensively, as will be apparent from the description below.

BRIEF DESCRIPTION OF THE DRAWINGS

These and further features and advantages of the present invention are described below in connection with the accompanying drawings, in which.

DETAILED DESCRIPTION OF ILLUSTRATIVE EMBODIMENTS

Figure 2:
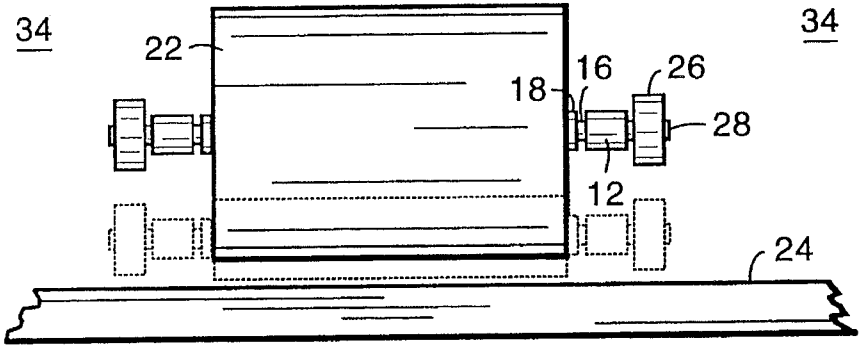
FIG. 2 is a front elevation of the roll of FIG. 1 with the stand base and actuator removed.
Figure 1:
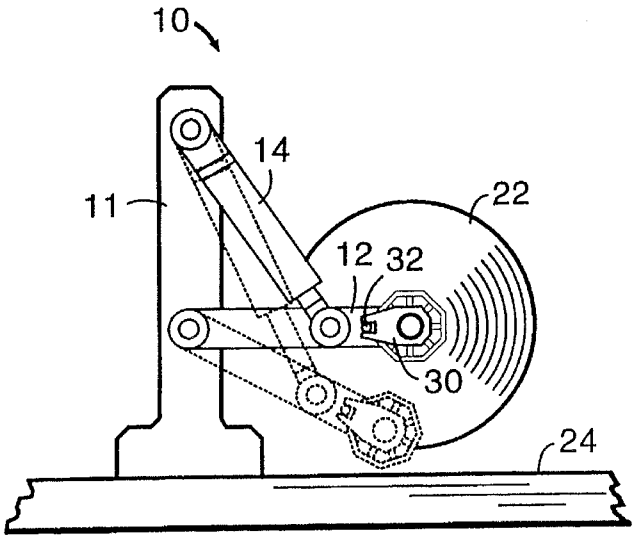
FIG. 1 is a side elevation of a roll stand provided with a brake in accordance with the teachings of the present invention.

A roll stand 10 of the type in which the present invention can be employed includes a base 11 that supports a generally horizontally extending roll-stand arm 12, possibly by way of an actuator 14 that is used to raise and lower the arm 12. The arm 12 includes a journal block in which is journaled a spindle 16 of an expanding core chuck 18 or other core coupler, such as a collet for engaging a core shaft, for supporting and torsionally engaging the core of a roll 22 of web material. If the roll stand 10 uses an actuator such as actuator 14 to support the roll-stand arm 12, the purpose usually is to permit the arm to pivot downward when the process is stopped but the roll is not yet exhausted, as is depicted in phantom in FIGS. 1 and 2, so that the resultant "tail" roll rests on the floor 24 and can be removed by rolling it away.

To control web tension, a brake 26 is employed that in accordance with the present invention takes the form of a generator driven by roll rotation. In the embodiment illustrated in FIGS. 1–4, the brake is mounted in a "shaft-hung" configuration, in which it is supported by the outer stub 28 of the spindle 16 in a manner that will be described in more detail below. Although the spindle 16 completely supports the brake 26 in the embodiment depicted in FIGS. 1–4, the generator stator must be prevented from rotating, and the generator housing accordingly forms an anti-rotation arm 30 that a pin 32 on the arm 12 engages for this purpose.

Mounting the brake on the stub 28 eliminates the potential alignment problems that necessitate complex and costly flexible couplings. Mounting in this fashion also avoids a generator brake-system package of the excessive axial length that characterizes prior-art systems, and it thereby minimizes intrusion of the brake into the service aisles 34, where fork lifts or other material-handling machinery must often pass.

Figure 3:
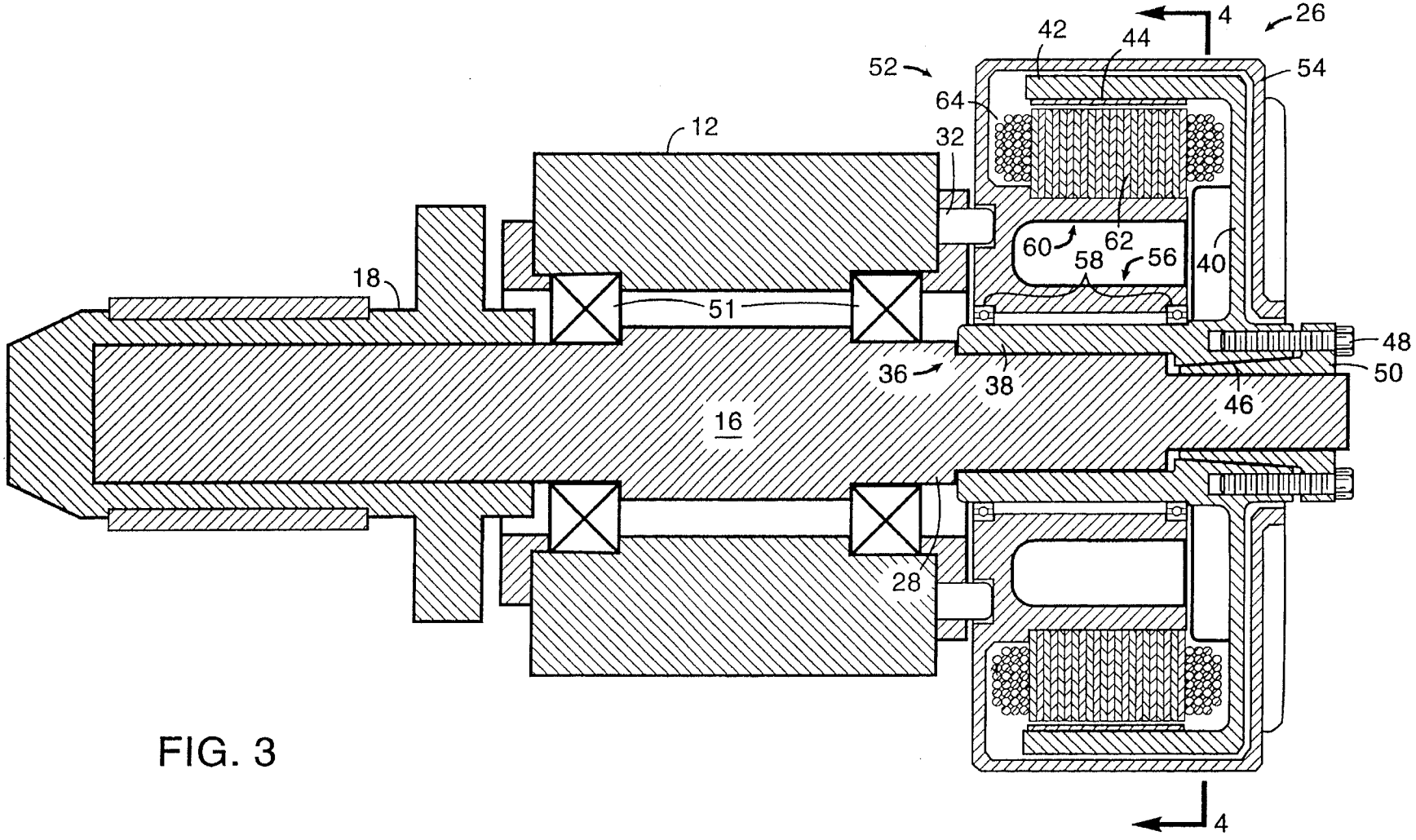
FIG. 3 is a cross-sectional view of the brake in position on an illustrative roll-stand spindle.

As FIG. 3 shows, the brake 26 is provided as a generator whose rotor 36 includes a hollow shaft 38 that opens into a radially extending disk 40. A cylindrical magnet "backiron" ring 42 of a magnetically permeable material such as cast steel extends axially from the outer end of the disk 40 and supports permanent magnets 44.

The shaft-hung configuration is possible because the recess formed by the hollow shaft 38 receives the spindle stub 28. In the illustrated embodiment, the hollow shaft's axially outer portion forms a radially inwardly inclined surface 46 against which bolts 48 wedge a locking collet 50 so as to secure the rotor 36 to the spindle 16, which is shown in FIG. 3 as being supported by bearings 51 in the journal block formed by the roll-stand arm 12.

The generator's stator is provided by a stator assembly 52 that forms an exterior housing 54 as well as a generator journal-block hub section 56 carried on bearings 58 by which the hollow rotor shaft 38 is journaled in the stator. The rotor thus supports the stator, and the core-chuck spindle 16 in turn supports the rotor.

Figure 4:
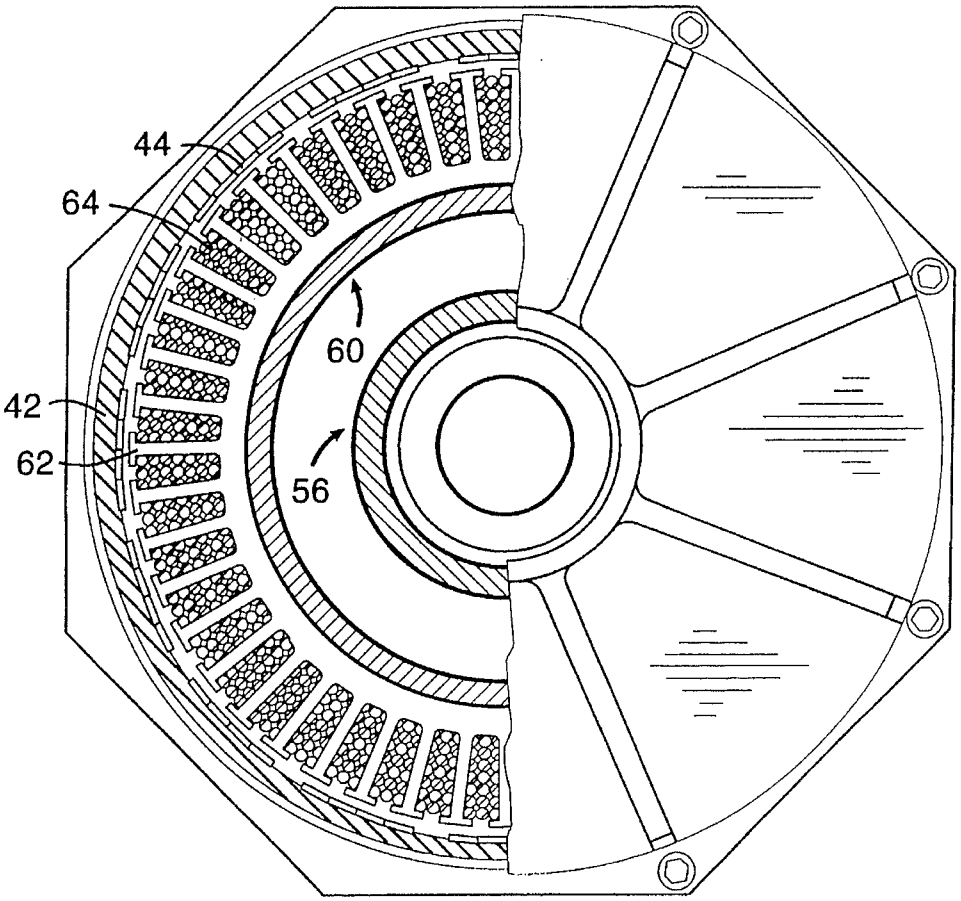
FIG. 4 is a partially sectional view of the brake taken at line 4—4 of FIG. 3.

As it is best appreciated by simultaneous reference to FIGS. 3 and 4, the stator assembly 52 further includes a generator journal block frame section 60 on which core laminations 62 are fit. Armature windings 64 are wound around the core laminations.

The "shaft-hung" configuration of FIGS. 1–4 is particularly beneficial for retrofit situations, in which a new brake is to be installed on an existing roll stand originally designed for a different type of brake, but the shaft-hung configuration is not the only arrangement that, according to the present invention, affords the benefits that result from eliminating complicated couplings.

Figure 5:
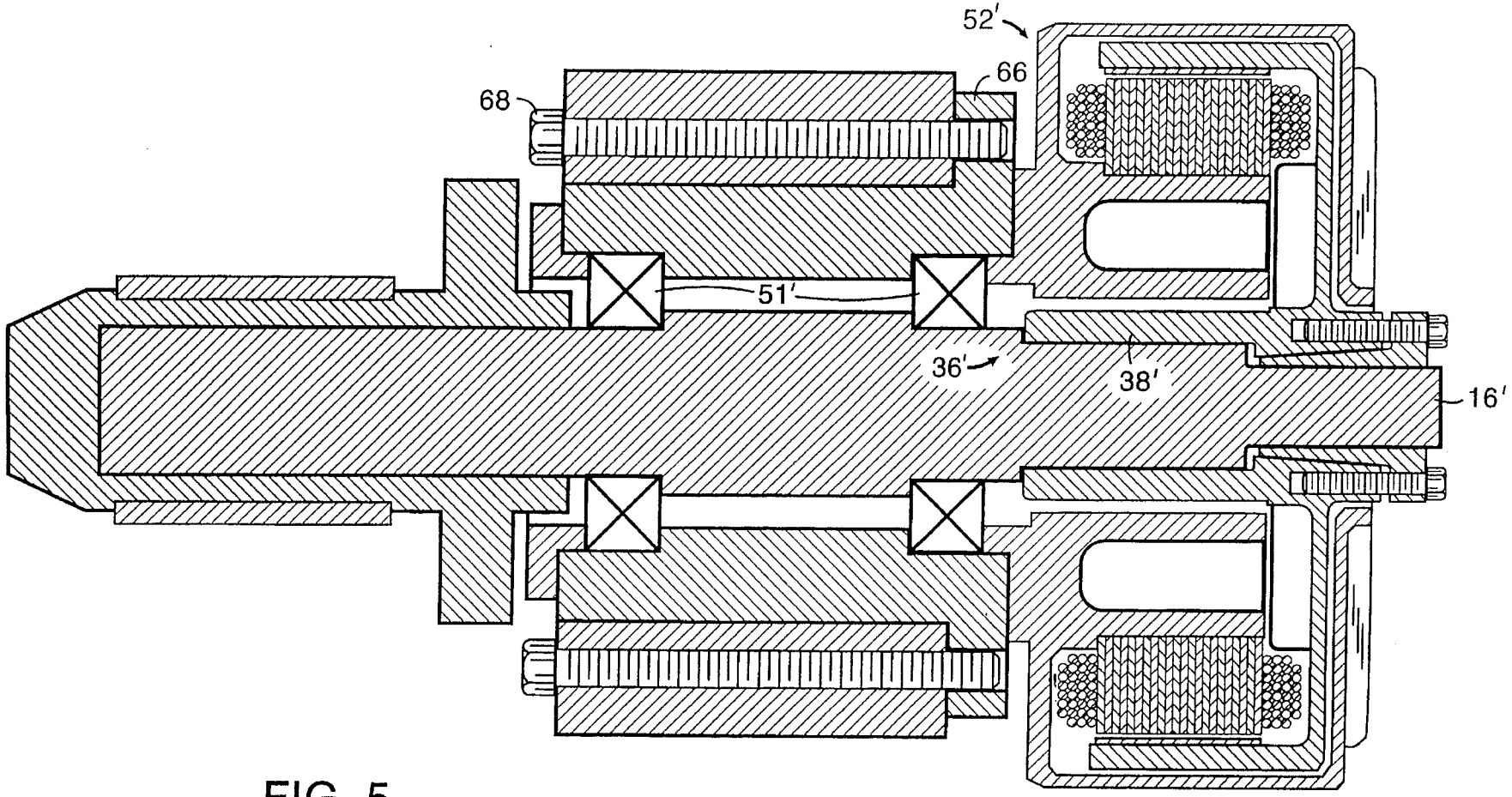
FIG. 5 is a view similar to FIG. 3 of an alternate version of the present invention.

FIG. 5 depicts an alternate arrangement, which is intended for roll stands whose arms are designed for installation and replacement of generator-type brakes. In the arrangement of FIG. 5, the rotor 36' is supported by the spindle 16', as is the rotor in the embodiment of FIGS. 1–4. However, the spindle 16' in this design does not additionally support the stator assembly 52': the rotor shaft 38' is not journaled in the stator. Instead, the stator 52' is supported by the arm directly rather than through the shaft 16', preferably being mounted on a replaceable bearing cartridge 66 in which the arm journal box is embodied in this embodiment, being secured to the body of the arm by bolts 68.

The generator and cartridge are manufactured together in this arrangement, possibly with the illustrative expanding core chuck and spindle included. Factory assembly of the cartridge and generator as a unit provides the necessary rotor-stator alignment, and, since the stator is separately supported, no separate bearings corresponding to bearings 58 of FIG. 3 are required at the axial position of the generator's stator armature and rotor magnets; i.e., the generator rotor is carried on spindle arm bearings 51'.

In both illustrated embodiments, the rotor comprises permanent-magnet field sources disposed radially outward of the stator-mounted armature windings. The broader teachings of the present invention do not require such an arrangement, but it does have certain advantages. Clearly, permanent magnets yield some circuitry simplification, reduce copper losses, and constitute a relatively compact field source. And when this compact source is disposed outside the armature windings, as it is in the illustrated embodiment, the generator air gap is disposed at a radius greater than it would be if the field magnets were disposed axially interior to the armature windings in a generator of the same overall size. The field-gap area, and thus the tractive force, can therefore be greater for a given stator-package overall diameter, axial length, and allowable copper losses. Since the force is applied at a greater radius, moreover, the resultant torque is increased not only by the greater force but also by a greater moment arm. As a consequence, the armature copper loss and resulting brake-temperature rise incurred to meet a given torque requirement are reduced.

This arrangement can therefore be provided in a relatively compact package for a given torque requirement and copper-loss constraint. The compactness of the package is particularly beneficial in those applications in which it is intended to rest tail rolls on the floor before the chucks release them. A smaller generator makes it possible to rest a smaller tail roll on the floor without interference by the generator housing. A further advantage of the illustrated generator brake is that the maximum dimension of the stator core laminations is reduced as is the fraction of unutilized material resulting from forming of these parts. Both factors significantly reduce the cost of fabricating the core.

While the preferred embodiment just described offers maximum torque production with minimum package size and copper losses, alternative generator architectures could be employed. For example, the field magnets might be replaced with conductive bars so set in slots of a laminated rotor backiron ring as to form a rotor of a squirrel-cage induction generator.

A significant part of the advantage of using a generator-type brake is that it lends itself to inexpensive, accurate control. This control is exercised by varying the load to which the generator output is applied. Load can be varied by changing the impedance of the load circuit, by pulse-width modulation of generator voltage, or by any other mechanism known to those skilled in the art.

Figure 6:
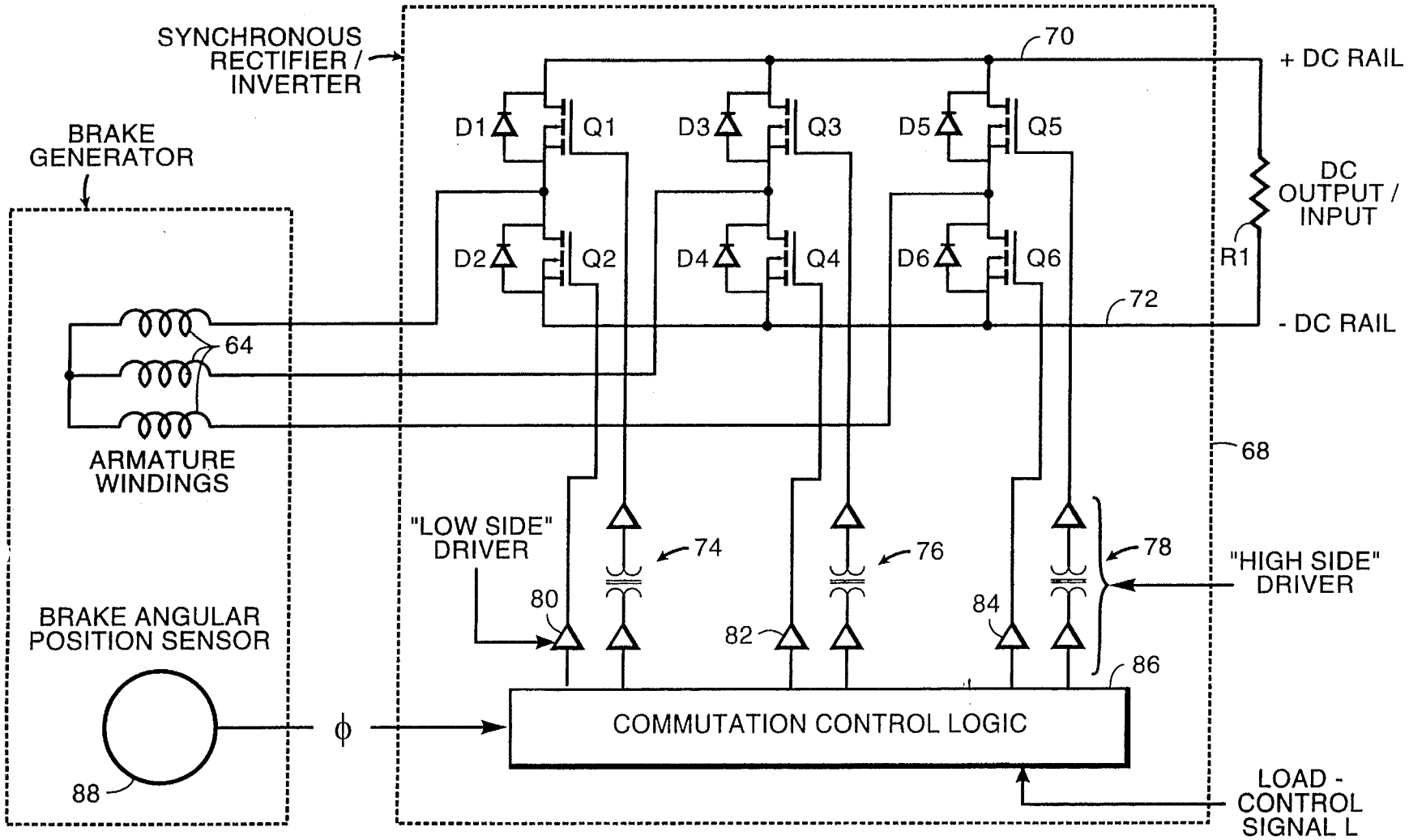
FIG. 6 is a schematic diagram of the generator load circuitry.

The type of load circuit is not in principle crucial to practice of the present invention, but FIG. 6 depicts an example. That drawing depicts the armature windings 64 as being provided in three phases, although other numbers of phases are likely to be employed in embodiments of the present invention. FIG. 6 shows the windings 64 as being connected for synchronous rectification of their output before it is applied to a ballast resistor R1. The ballast resistor is typically disposed at a remote location, where its dissipated power is conductively removed by the air or, for instance, by process fluids to be heated. Of course, there is no reason why the generator output needs to be rectified before being applied to a ballast resistor, but a typical installation will provide rectification against the possibility that generator power will some day need to be reclaimed by inverting it and applying it to plant supply lines. Additionally, by the addition of a DC power source and operation of the synchronous rectifier as an inverter, the brake can be operated as a motor to provide a "plug braking" mode to achieve enhanced roll deceleration in response to stop or emergency-stop commands. This mode of operation is more fully described below.

For these reasons, control transistors Q1 through Q6 paralleled by respective "freewheeling" diodes D1–D6 are provided to control the application of the phase voltages to high and low DC supply rails 70 and 72 in response to signals from high-side drivers 74, 76, and 78 and low-side drivers 80, 82, and 84, which in turn are controlled by commutation control logic 86. Control logic 86 determines when and to which sides of the load to connect the various phases in accordance with the position $\phi$ of the generator's rotor, which it obtains from an angular-position sensor 88. The angular-position sensor 88 could be a separate conventional encoder, but the angular position may instead be inferred simply from the armature-winding signals.

The commutation control logic 86 may be of any type ordinarily employed for synchronous rectification, but it is preferable for it to be of the type whose duty cycle can be controlled so as to provide a convenient mechanism for varying generator load. For this reason, FIG. 6 depicts it as having a load-control signal applied to it.

We now turn to the manner in which the generator load is controlled. As certain prior-art systems do, the control system illustrated in FIGS. 7–9 achieves high tension accuracy by dosed-loop control. Unlike such systems, however, the illustrated system closes the loop by feeding back a quantity whose measurement is inexpensive to provide, namely, generator load current. While the relationship between this feedback quantity and web tension is not itself direct, the system uses other inexpensively measured quantities, such as web speed and the flux density in the generator air gap, to compensate for effects that would otherwise prevent accurate control by load-current feedback.

Figure 7:
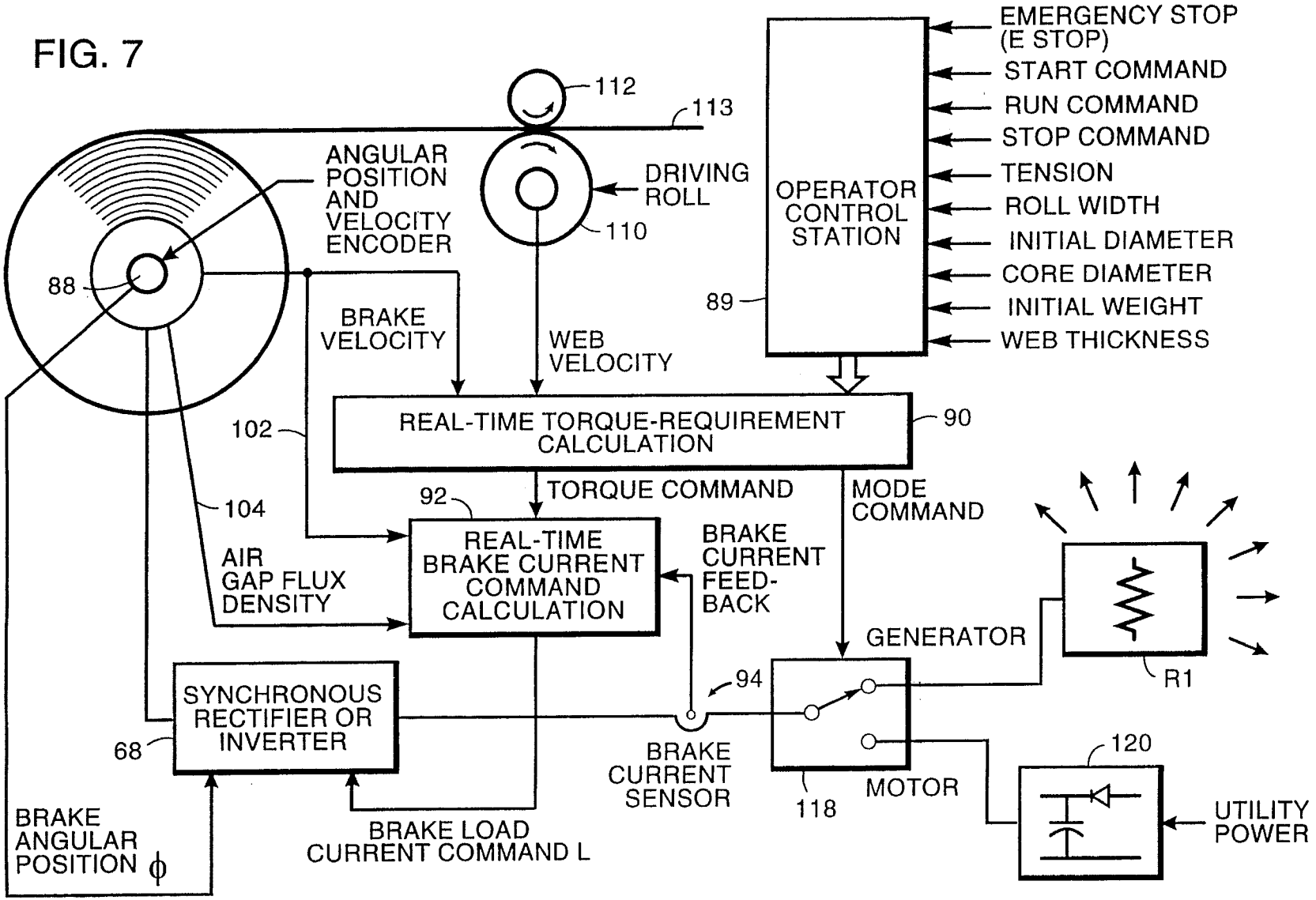
FIG. 7 is a block diagram of a control system employed to control the brake depicted in FIGS. 1–4.

FIG. 7 depicts the control system in diagrammatic form. It includes an operator control station 89, by which the operator enters commands and various operating parameters for purposes that will be discussed presently. Typical commands, as FIG. 7 indicates, are START, RUN, STOP, EMERGENCY STOP. For present purposes, these commands can be thought of simply as establishing different desired web tensions. I will describe in detail only the mode that results from the RUN command, which typically would be automatically issued at the end of the start sequence.

The control station forwards parameters and commands from the user to processing circuitry 90, which typically takes the form of a microprocessor, appropriate memory, and various peripheral devices. The processing circuitry 90 determines the necessary torque level from the user-entered parameters and various sensor inputs to be described below.

Shown for conceptual purposes as a separate block is the brake-current controller 92, which nonetheless would typically be implemented by the same microprocessor that performs the torque-calculation operation 90. Its purpose is to control the current driven by the synchronous rectifier 68 through the ballast resistor R1. In accordance with the present invention, this control is based on feedback of a current-indicating signal from, for instance, a current sensor 94. As was mentioned above, the brake-current controller 92 could be, for instance, a variable impedance, which is controlled in response to the feedback signal and a torque command from the torque-calculation circuitry 90. In most instances, however, the brake-generator load current will be controlled by varying the synchronous rectifier's duty cycle according to a load-current command L, which typically would be generated by the same microprocessor and other circuitry that calculate the necessary torque.

Figure 8:
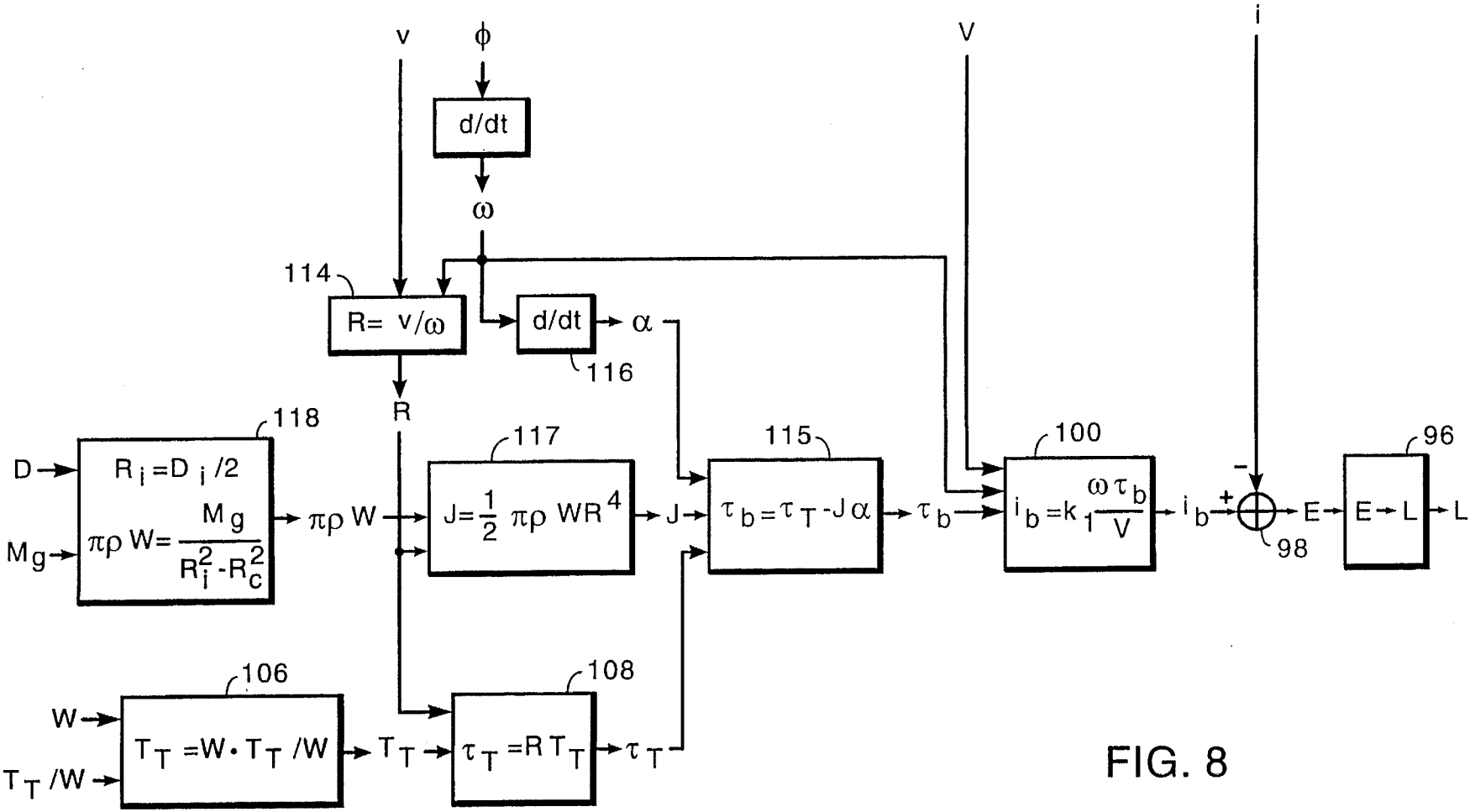
FIG. 8 is a block diagram depicting the computations performed by that control system's processing circuitry.

FIG. 8 depicts the calculation of the proper load-current command L. The load-current command L is generated from an error signal E in any of the ways conventionally employed for this purpose. The calculation may implement a simple proportionality relationship, apply some other linear transfer function such as a proportional-plus-integral-plus-derivative function, or, conceivably, perform more-elaborate processing. In any event, the error signal E represents the difference between the target generator current or torque and the measured generator current or torque. Block 96 represents this processing.

To emphasize the current-feedback nature of the control system, FIG. 8 depicts a subtraction operation 98 as generating the error signal E by subtracting the output i of the current sensor 94 from a target brake current $i_b$, which in turn is depicted in FIG. 8 as being computed in step 100 from a target brake torque $\tau_B$. Of course, the exactly equivalent current-feedback operation could be performed by applying to the current-sensor output i the inverse of the function performed in step 100 and subtracting the result from $\tau_b$ to obtain an error value E that, although different from the error value E obtained in the illustrated way, would be proportional to it.

In some embodiments of the present invention, it may be adequate to calculate the target brake current $i_b$ from the target brake torque simply by multiplying $\tau_b$ by a proportionality constant. But this approach does not take into account the effects of magnetic-circuit saturation, which make the relationship between a current and torque nonlinear, and it also does not take into account uncertainty in the current-torque relationship that can result from temperature variations, normal variations in brake-material properties and dimensions and, to some extent, certain age effects. These effects all tend to cause deviations of the air-gap field flux density from a nominal constant design point value, which in turn results in departure from torque-current proportionality.

To compensate for these factors, embodiments of some aspects of the invention may employ a load cell between the generator frame and the roll-stand arm and use its output as an indication of brake torque. Presumably, many practical factors will necessitate filtering or averaging of such measurement so that they would not alone lend themselves to adequately rapid response. To overcome this problem, sample torque values can be stored in a look-up table with the current measurements taken at the same time, and the look-up table can then be employed to convert target brake torque $\tau_b$ more accurately to target brake current $i_b$ or (in the alternative not shown at FIG. 8) to convert sensed current i to a "sensed" torque value $\tau$ that is subtracted from the target brake torque $\tau_b$ to obtain the error signal E.

Figure 9:
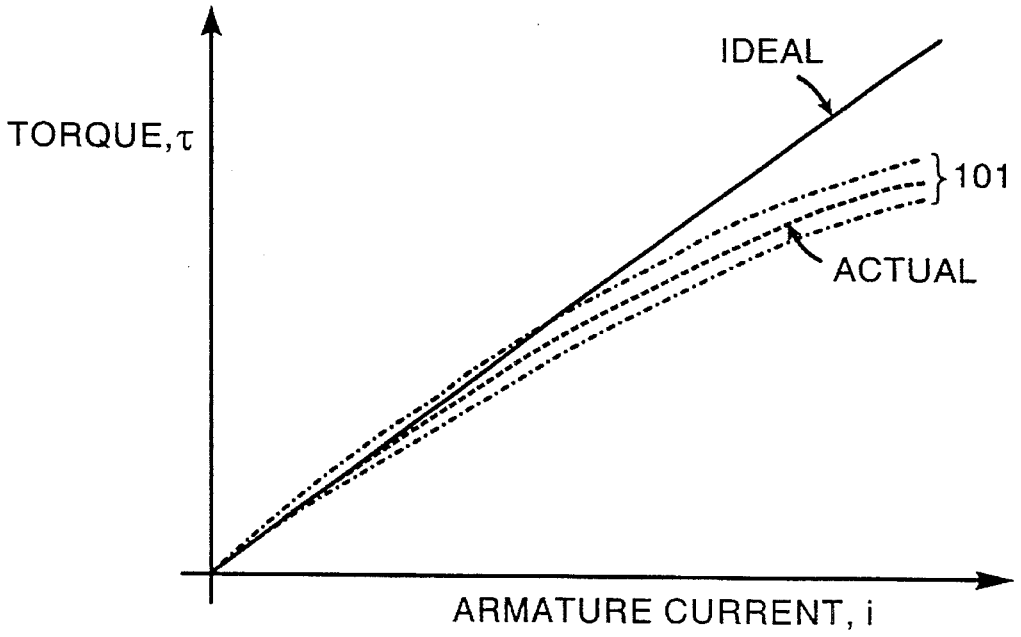
FIG. 9 is a graph of the relationship between generator torque and armature current.
Figure 10:
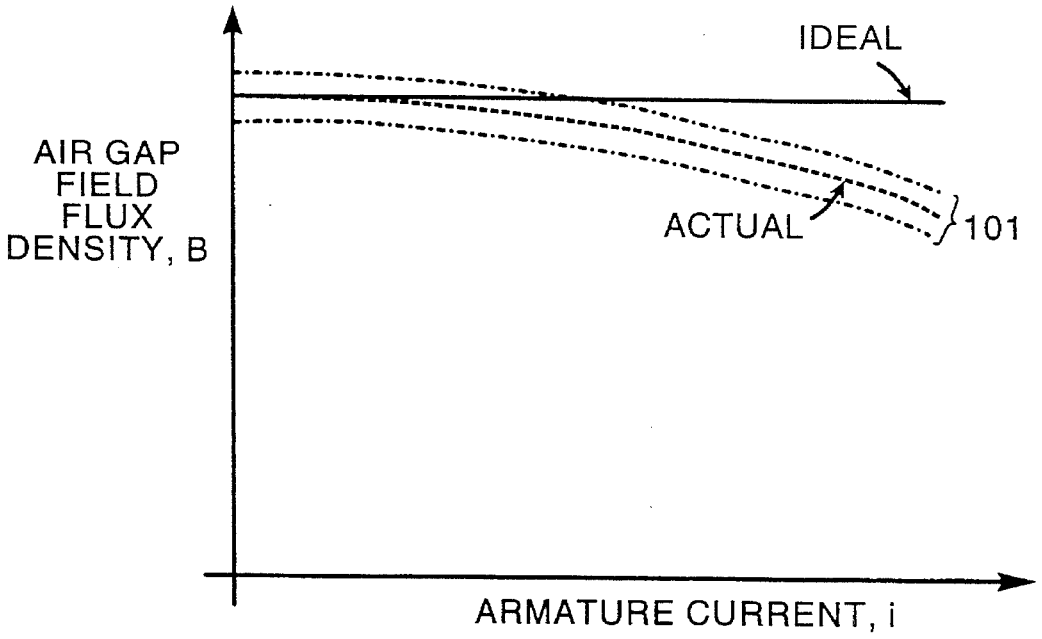
FIG. 10 is a graph of the relationship between the magnetic flux density in the generator air gap and the armature current.

However, I propose to use an even simpler method of correcting for the lack of linearity and repeatability in the current-torque relationship. In particular, I propose to base this correction on a flux-density measurement. FIG. 9 depicts the typical fall-off of generator torque due to the demagnetizing effect of a cross-magnetizing armature reaction, which is well-known to those skilled in the art. Also indicated is the band of uncertainty 101 in this torque-current relationship due to the effects of temperature, manufacturing deviations, and aging on the air-gap flux density. The torque fall-off with armature current and the uncertainty band arise from deviations, depicted in FIG. 10, from the ideal constant air-gap flux-density characteristic.

The deviation in torque at any armature current from the ideal value due to armature reaction, temperature, manufacturing deviations, and aging can be determined from knowledge of the air-gap flux density B. The air-gap flux density may be observed by a sense winding set into the armature core slots or by other means such as a Hall-effect sensor recessed into the surface of the armature core at the air-gap interface.

For example, a small number of unloaded sense windings—say, even only a single winding-wound with one or more of the armature phases will produce an output voltage proportional to the product of the magnetic flux density and the angular velocity. Dividing the resultant voltage V output by the brake generator angular velocity $\omega$ therefore yields a quantity proportional to the magnetic flux density. Multiplying this quantity by the measured armature current yields a quantity proportional to brake torque. Thus, even though the relationship between torque and current is typically non-linear and may drift, one can inexpensively obtain a torque indication that does not have these drawbacks.

Figure 11:
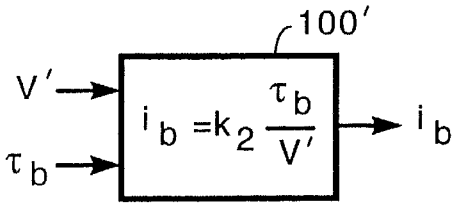
FIG. 11 depicts an alternate embodiment of the target-generator-current determination of FIG. 8.

For this purpose, FIG. 8 shows the torque-to-current-conversion block 100 as receiving the brake-generator angular velocity $\omega$ and the output voltage V of the flux-sensing windings. Signal lines 102 and 104 in FIG. 7 represent these inputs. If air-gap flux density is observed with a non-speed-sensitive device such as a Hall-effect sensor providing a flux density analog voltage V', then block 100' depicted in FIG. 11 would be employed, and no angular-velocity input would be required.

The computation of the target brake torque $\tau_b$ begins with a determination of the target tension $T_T$. This typically is an input from the user, as the "Tension" legend in FIG. 7 indicates. In many cases, however, the more-conveniently known parameter is not tension but rather tension per unit width. Indeed, the input may take the form not of an explicit value but rather of the web material's name, which will be converted, by reference to a previously entered database, to a tension-per-unit-width value. Block 106 in FIG. 8 represents the calculation of the target tension $T_T$ from that parameter and a roll width W entered by the operator.

To determine from the desired web tension $T_T$ a target roll torque $\tau_T$ that the web should exert on the roll and vice versa, one simply multiplies the desired tension by the roll radius R, as block 108 indicates. The roll radius can be sensed directly by, say, an ultrasonic or optical sensor or feeler roller. (To avoid inaccuracies that might otherwise be caused by roll eccentricity, the roll radius R should be measured at the point where the web leaves the roll.) But the installation will of necessity have a drive roll 110 and nip roll 112 for driving the web 113, as FIG. 7 indicates, and some type of sensor such as an angular-position encoder on one of these rolls typically will have already been provided to supply a web-speed indication for other purposes. So the radius value R can be determined simply by dividing that available speed value by the brake's angular speed, as block 114 indicates.

Now, the roll may have some eccentricity. Variations in roll radius that occur every revolution may therefore be superimposed on the longer-term variation in roll radius that results from the unwinding of the web. These variations can significantly affect torque, so it is important that they be measured accurately. The electronic circuitry used to compute the radius will ordinarily be more than fast enough to perform the computation in real time, but there may be small errors in the measured values of web speed and roll angular velocity due, for example, to web vibration and drive-roll slippage. For that reason, some embodiments of the invention will record the eccentricity observed over previous revolutions and feed this forward (with an appropriate adjustment for the intervening web removal) to arrive at a more-accurate estimate of the real-time radius. In support of the latter possibility, FIG. 7 shows a "web thickness" input to be used for the web-removal adjustment, but FIG. 8 does not explicitly depict such a "feed-forward" determination in block 114.

Regardless of the manner in which the radius R is determined, the output $\tau_T$ of the operation represented by block 108 indicates the roll torque that will result in the desired web tension. In certain applications, this target roll torque $\tau_T$ can be employed as the target brake torque $\tau_b$. However, the roll torque—i.e., the product of web tension and roll radius—is not necessarily the same as brake torque. Specifically, the roll torque is the sum of the brake torque and the inertial torque:

$$\tau_T \tau_b + Ja,$$

where J is the roll's moment of inertia and a is its angular acceleration.

Although some angular acceleration does result from the fact that the roll angular velocity increases as its radius decreases if the web speed remains largely constant, as is usually the case, this angular acceleration is ordinarily negligible. But contributions to inertial torque that result, for instance, from roll eccentricity can be significant. If we assume that web speed remains precisely constant, then the roll will have to undergo angular acceleration and deceleration if it has some eccentricity. Without appropriate control, this is not what happens, of course; the acceleration and deceleration will be less than that which roll eccentricity would cause in the absence of significant roll inertia, and the result is that the web tension, and possibly the web speed, undergo undesirable periodic variation. So if tension is to be kept constant despite such eccentricity, compensation must be provided, and this is the purpose of the operation represented by block 115, which subtracts inertial torque Ja from the target roll torque $\tau_T$ to yield the target brake torque $\tau_b$. Straightforward differentiation 116 of the angular velocity $\omega$ yields the angular acceleration a needed to compute the inertial torque Ja. The moment of inertia J is a function of R: $J(R)=\frac{1}{2}\pi\rho W(R^4-R_c^4)$, where $\rho$ is mass density, W is roll width, an $R_c$ is the roll's core radius. The operator typically enters the roll width W explicitly, and he typically enters the density $\rho$ by entering an initial weight Mg, an initial diameter $D_i$, half of which is an initial radius $R_i$, and the core diameter $D_c$, half of which is the core radius $R_c$. It can be shown that the weight Mg is given by:

$$Mg=\pi\rho W(R_i^2-R_c^2),$$

from which the mass density is readily determined:

$$\rho=\frac{Mg}{\pi(R_i^2-R_c^2)}.$$

Blocks 117 and 118 represent these computations. In practice, little inaccuracy results from omitting the $R_c$ term in the previous calculations, and this practice could be adopted to avoid the necessity for operator entry of the core diameter.

This completes the description of the response to the RUN command. The responses to other commands are largely the same; the chief difference is that they would typically employ values of target tension $T_T$ that are different from that which the operator enters explicitly and may have time-varying profiles.

However, during a stop or emergency-stop operation the generator brake torque obtainable at roll angular speeds well below the minimum operational speed may be less than required to bring the roll to a full stop without excessive coasting and festooning of web material. In generator-mode operation the brake output value will decline unevenly with speed, and it may be shown that, absent any web tension as might occur in the case of an emergency stop due to a web break, the roll speed will decline in an exponential fashion. For example, an illustrative roll of 80" width and 60" full diameter will reach nominally zero speed under broken-web emergency-stop conditions without web tension in approximately 10 seconds and will festoon approximately 58 feet of material for the worst-case conditions wherein the STOP command is issued when the roll is at operational speed and the roll diameter is nominally full.

Some installations, however, may require more-aggressive braking in response to stop or emergency-stop commands. A mode-change switch 118 (FIG. 7) and a power supply 120 are therefore provided for "plug braking," in which the brake is momentarily operated as a motor to oppose roll rotation-and the synchronous rectifier is operated as an inverter—to provide braking torque at very low roll speeds. In the previous example a brief application of plug braking torque can be used to truncate the exponential "tail" of the roll-velocity decline and achieve a full stop in only 2.7 seconds with only 14 feet of material spilled into a festoon.

From the foregoing description, it will be apparent that use of the installation approach of the present invention makes it more feasible to obtain the benefits of a generator-type brake in a wider range of roll-stand environments. Moreover, by using current feedback to control the brake, one can obtain accurate and highly responsive tension control without expensive direct measurement of web tension. It is thus apparent that the present invention constitutes a significant advance in the art.

What is claimed is:

1. A roll stand comprising:

A) a base;

B) a roll-stand arm mounted on the base and including an arm journal block;

C) a spindle terminating in a roll core coupler and journaled in the arm journal block for support of the spindle by the roll-stand arm; and D) a permanent-magnet generator comprising:

i) a stator including a generator journal block; and ii) a rotor including a hollow rotor shaft journaled in the generator journal block for support of the stator by the rotor shaft and forming an axially extending recess that receives the spindle and is secured thereto for support of the generator by the spindle.

2. A roll stand as defined in claim 1 wherein:

A) the rotor comprises permanent mangets that produce time-varying fields in the stator as the rotor rotates; and B) the stator comprises armature windings disposed in the time-varying fields that result from rotor rotation.

3. A roll stand as defined in claim 2 wherein the permanent magnets are disposed radially outward of the armature windings.

4. A roll stand as defined in claim 1 wherein the roll core coupler. comprises a core chuck.

5. A roll stand comprising:

A) a base;

B) a roll-stand arm mounted on the base and including an arm journal block;

C) a spindle terminating in a roll core coupler and journaled in the arm journal block for support of the spindle by the roll-stand arm; and D) a permanent-magnet generator axially displaced from the arm journal block and comprising:

E) a stator mounted on the roll-stand arm for support thereby; and

F) a rotor including a rotor shaft axially rigidly secured to the spindle for support of the rotor by the spindle.

6. A roll stand as defined in claim 5 wherein:

A) the rotor comprises permanent magnets that produce time-varying fields in the stator as the rotor rotates; and B) the stator comprises armature windings disposed in the time-varying fields that result from rotor rotation.

7. A roll stand as defined in claim 6 wherein the permanent magnets are disposed radially outward of the armature windings.

8. A roll stand as defined in claim 5 wherein the roll core coupler comprises a core chuck.

9. A roll stand as defined in claim 5 wherein the rotor shaft forms an axially extending recess that receives the spindle and is secured thereto to provide the axially rigid coupling.

10. For use with a roll stand that rotatably supports a roll of web material, a control system for controlling a roll-stand brake in the form of a generator driven by the rotation of a roll rotatably mounted on a roll stand, the control system comprising:

A) a variable load connected to be driven by the generator and variable by application of load-control signals thereto;

B) a current sensor for sensing the current that the generator delivers to the load and generating a current-sensor output indicative thereof;

C) further sensor circuitry for sensing at least one of the combination of generator angular velocity and roll radius, that of generator angular velocity and web speed, and that of web speed and roll radius and generating further-sensor outputs indicative thereof;

D) a error-determining circuit for determining from the further sensor outputs a target brake torque without separately measuring web tension and for calculating an error value proportional to the difference between the target brake torque and a brake torque indicated by the current-sensor output; and E) a load controller responsive to the error value for so controlling the load as to tend to reduce the error value.

11. A control system as defined in claim 10 wherein:

A) the generator includes armature windings through which the load current flows;

B) the further sensor circuitry includes a flux-density sensor for measuring the magnetic-flux density experienced by the armature windings; and C) the error-determining circuit calculates the error value by comparing a quantity proportional to the current-sensor output with a quantity proportional to the result of dividing the target brake torque by the magnetic-flux density measured by the flux-density sensor.

12. A control system as defined in claim 10 wherein:

A) the generator includes armature windings through which the load current flows;

B) the further sensor circuitry includes a flux-density sensor for measuring the magnetic-flux density experienced by the armature windings; and C) the error-determining circuit calculates the error value by comparing a quantity proportional to the target brake torque with a quantity proportional to the result of multiplying the currentsensor output by the magnetic-flux density measured by the flux-density sensor.

13. A control system as defined in claim 10 wherein the errordetermining circuit determines a roll-radius value from the further-sensor outputs and determines the target brake torque by computing a target-torque value proportional to the product of a target tension and the roll-radius value.

14. A control system as defined in claim 13 wherein:

A) the further sensors sense web speed and generator angular speed; and

B) the error-determining circuit determines the roll-radius value by computing a value proportional to the ratio of the sensed web speed to the sensed generator angular speed.

15. A control system as defined in claim 10 wherein the error-determining circuit determines the roll's inertial torque from the further-sensor outputs and determines the target brake torque by computing the difference between a target roll torque and the inertial torque.

16. A control system as defined in claim 10 wherein:

A) the further sensors sense web speed and generator angular speed; and

B) the error-determining circuit determines a roll-radius value by computing a value proportional to the ratio of the sensed web speed to the sensed generator angular speed, determines an angular-acceleration value by differentiating the sensed generator angular speed, and determines the roll's inertial torque from the roll-radius and angular-acceleration values thus determined.

17. A roll-stand-brake assembly comprising:

A) a bearing cartridge for mounting thereof in the body of a roll-stand arm to form an arm journal block;

B) a spindle terminating in a roll core coupler and journaled in the bearing cartridge for support of the spindle by the roll-stand arm when the bearing cartridge is mounted in the roll-stand arm; and C) a permanent-magnet generator axially displaced from the arm journal block and comprising:

D) a stator mounted on the bearing cartridge for support of the stator by the roll-stand arm when the bearing cartridge is mounted therein; and E) a rotor including a rotor shaft axially rigidly secured to the spindle for support of the rotor by the spindle.

18. A roll-stand-brake assembly as defined in claim 17 wherein:

A) the rotor comprises permanent magnets that produce time-varying fields in the stator as the rotor rotates; and B) the stator comprises armature windings disposed in the time-varying fields that result from rotor rotation.

19. A roll-stand-brake assembly as defined in claim 18 wherein the permanent magnets are disposed radially outward of the armature windings.

20. A roll-stand-brake assembly as defined in claim 17 wherein the roll core coupler comprises a core chuck.

21. A roll-stand-brake assembly as defined in claim 17 wherein the rotor shaft forms an axially extending recess that receives the spindle and is secured thereto to provide the axially rigid coupling.

22. For achieving a target torque in a generator or motor comprising armature windings for conducting armature current, a method comprising the steps of:

A) measuring the magnetic-flux density experienced by the armature windings;

B) measuring the armature current;

C) computing an error value proportional to the difference between the target torque and a quantity proportional to the product of the measured magnetic-flux density and the measured armature current; and D) so controlling the armature current as to tend to reduce the error value.

* * * * *